US007098806B2

(12) United States Patent
Bachelder

(10) Patent No.: US 7,098,806 B2
(45) Date of Patent: Aug. 29, 2006

(54) TRAFFIC PREEMPTION SYSTEM

(75) Inventor: Aaron D. Bachelder, Irvine, CA (US)

(73) Assignee: California Institute of Technology, Pasadena, CA (US)

( * ) Notice: Subject to any disclaimer, the term of this patent is extended or adjusted under 35 U.S.C. 154(b) by 0 days.

(21) Appl. No.: 10/965,408

(22) Filed: Oct. 12, 2004

(65) Prior Publication Data

US 2005/0128103 A1 Jun. 16, 2005

Related U.S. Application Data

(63) Continuation-in-part of application No. 10/811,075, filed on Mar. 24, 2004, which is a continuation-in-part of application No. 10/642,435, filed on Aug. 15, 2003, now Pat. No. 6,940,422.

(60) Provisional application No. 60/510,603, filed on Oct. 10, 2003, provisional application No. 60/403,916, filed on Aug. 15, 2002.

(51) Int. Cl.
*G08G 1/07* (2006.01)

(52) U.S. Cl. ..... 340/906; 340/907; 340/916; 701/116

(58) Field of Classification Search ..... 340/906, 340/902, 904, 910, 916, 917, 924, 426.19, 340/539.2, 907; 701/116, 117, 213
See application file for complete search history.

(56) References Cited

U.S. PATENT DOCUMENTS

| | | | | |
|---|---|---|---|---|
| 3,550,078 A | 12/1970 | Long | ..... | 340/32 |
| 3,831,039 A | 8/1974 | Henschel | ..... | 307/324 |
| 3,859,624 A | 1/1975 | Kriofsky et al. | ..... | 340/38 L |
| 3,881,169 A | 4/1975 | Malach | ..... | 340/32 |

(Continued)

FOREIGN PATENT DOCUMENTS

EP 0 574 009 A2 12/1993

(Continued)

OTHER PUBLICATIONS

Co-pending U.S. Appl. No. 10/704,530, filed Nov. 7, 2003, entitled Method and System for Beacon/Heading Emergency Vehicle Intersection Preemption.

(Continued)

*Primary Examiner*—Phung T. Nguyen
(74) *Attorney, Agent, or Firm*—Christie, Parker & Hale, LLP

(57) ABSTRACT

A traffic preemption system is described that includes onboard equipment located on a vehicle and a fleet management center in communication with the onboard equipment. The fleet management center is also in communication with a traffic management center that is in communication with at least one intersection controller, which controls the signals displayed at a traffic intersection. In one embodiment, the invention includes a vehicle equipped with an onboard computer system capable of capturing diagnostic information, estimating the location of the emergency vehicle using information provided by a GPS receiver connected to the onboard computer system and transmitting the captured diagnostic information and estimated location using a wireless transmitter connected to the onboard computer system via a first wireless network. Also included is a fleet management computer system connected to a wireless receiver, where the fleet management computer system and wireless receiver are capable of receiving information transmitted by the on-board equipment, determining whether the received information is from a vehicle requiring intersection preemption and providing the estimated location of vehicles requiring intersection preemption to a traffic management computer system. The traffic management computer system is capable of receiving estimated locations of vehicles requiring intersection preemption from the fleet management computer system and forwarding preemption requests to intersection controllers via a second network.

22 Claims, 10 Drawing Sheets

U.S. PATENT DOCUMENTS

| | | | | |
|---|---|---|---|---|
| 3,886,515 | A | 5/1975 | Cottin et al. | 340/23 |
| 4,017,825 | A | 4/1977 | Pichey | 340/32 |
| 4,162,477 | A | 7/1979 | Munkberg | 340/32 |
| 4,223,295 | A | 9/1980 | Bonner et al. | 340/32 |
| 4,230,992 | A * | 10/1980 | Munkberg | 327/44 |
| 4,234,967 | A | 11/1980 | Henschel | 455/603 |
| 4,296,400 | A | 10/1981 | Becker Friedbert et al. | 340/32 |
| 4,433,324 | A | 2/1984 | Guillot | 340/923 |
| 4,443,783 | A | 4/1984 | Mitchell | 340/32 |
| 4,573,049 | A | 2/1986 | Obeck | 340/924 |
| 4,661,799 | A | 4/1987 | Buttemer | 340/941 |
| 4,701,760 | A | 10/1987 | Raoux | 340/993 |
| 4,704,610 | A | 11/1987 | Smith et al. | 340/906 |
| 4,713,661 | A | 12/1987 | Boone et al. | 340/994 |
| 4,734,863 | A | 3/1988 | Honey et al. | 364/449 |
| 4,734,881 | A | 3/1988 | Klein et al. | 364/900 |
| 4,775,865 | A | 10/1988 | Smith et al. | 340/906 |
| 4,791,571 | A | 12/1988 | Takahashi et al. | 364/436 |
| 4,799,162 | A | 1/1989 | Shinkawa et al. | 364/436 |
| 4,914,434 | A | 4/1990 | Morgan et al. | 340/906 |
| 4,963,889 | A | 10/1990 | Hatch | 340/357 |
| 5,014,052 | A | 5/1991 | Obeck | 340/906 |
| 5,043,736 | A | 8/1991 | Darnell et al. | 342/357 |
| 5,068,656 | A | 11/1991 | Sutherland | 340/989 |
| 5,072,227 | A | 12/1991 | Hatch | 342/357 |
| 5,083,125 | A | 1/1992 | Brown et al. | 340/906 |
| 5,089,815 | A | 2/1992 | Potter et al. | 340/905 |
| 5,119,102 | A | 6/1992 | Barnard | 342/357 |
| 5,172,113 | A | 12/1992 | Hamer | 340/907 |
| 5,177,489 | A | 1/1993 | Hatch | 324/357 |
| 5,187,373 | A | 2/1993 | Gregori | 250/551 |
| 5,187,476 | A | 2/1993 | Hamer | 340/906 |
| 5,204,675 | A | 4/1993 | Sekine | 340/933 |
| 5,214,757 | A | 5/1993 | Mauney et al. | 395/161 |
| 5,334,974 | A | 8/1994 | Simms et al. | 340/990 |
| 5,345,232 | A | 9/1994 | Robertson | 340/906 |
| 5,539,398 | A | 7/1996 | Hall et al. | 340/907 |
| 5,602,739 | A | 2/1997 | Haagenstad et al. | 364/436 |
| 5,710,555 | A | 1/1998 | McConnell et al. | 340/916 |
| 5,745,865 | A | 4/1998 | Rostoker et al. | 701/117 |
| 5,889,475 | A | 3/1999 | Klosinski et al. | 340/902 |
| 5,926,113 | A | 7/1999 | Jones et al. | 340/906 |
| 5,955,968 | A * | 9/1999 | Bentrott et al. | 340/906 |
| 5,986,575 | A | 11/1999 | Jones et al. | 340/906 |
| 6,064,319 | A * | 5/2000 | Matta | 340/917 |
| 6,232,889 | B1 | 5/2001 | Apitz et al. | 340/906 |
| 6,243,026 | B1 * | 6/2001 | Jones et al. | 340/906 |
| 6,326,903 | B1 | 12/2001 | Gross et al. | 340/988 |
| 6,603,975 | B1 | 8/2003 | Inouchi et al. | 455/450 |
| 6,617,981 | B1 | 9/2003 | Basinger | 340/909 |
| 6,621,420 | B1 | 9/2003 | Poursartip | 340/907 |
| 6,633,238 | B1 | 10/2003 | Lemelson et al. | 340/909 |
| 6,690,293 | B1 | 2/2004 | Amita | 340/928 |
| 6,724,320 | B1 | 4/2004 | Basson et al. | 340/906 |
| 6,909,380 | B1 | 6/2005 | Brooke | 340/906 |
| 2004/0196162 | A1 * | 10/2004 | Brooke | 340/906 |

FOREIGN PATENT DOCUMENTS

| | | |
|---|---|---|
| FR | 2 670 002 A1 | 6/1992 |
| FR | 2 693 820 A1 | 1/1994 |

OTHER PUBLICATIONS

Co-pending U.S. Appl. No. 10/696,490, filed Oct. 28, 2003, entitled Method and Apparatus for Alerting Civilian Motorists to the Approach of Emergency Vehicles.

Co-pending U.S. Appl. No. 10/960,129, filed Oct. 6, 2004, entitled Detection and Enforcement of Failure-to-Yield in an Emergency Vehicle Preemption System.

Co-pending U.S. Appl. No. 10/410,582, filed Apr. 8, 2003, entitled Emergency Vehicle Control System Loop Preemption.

Co-pending U.S. Appl. No. 10/942,498, filed Sep. 15, 2004, entitled Forwarding System for Long-Range Preemption and Corridor Clearance for Emergency Response.

*Intelligent Investment*, World Highways/Routes Du Monde, Jan./Feb. 1997, p. 52.

*Traffic Preemption System for Emergency Vehicles Based on Differential GPS and Two-Way Radio*, Priority One GPS, Midwest Traffic Products, Inc. 4 pages.

*Traffic Preemption System for Emergency and Transit Vehicles Based on Differential GPS & Two-Way Radio*, Priority One GPS, Traffic Preemption System, 3 pgs.

*GPS and Radio Based Traffic Signal Preemption System for Emergency Vehicles*, Priority One GPS Specification for Emergency Vehicles, 7 pp.

Emergency Preemption Systems, Inc. website, 2 pp.

Sonic Systems website, *Traffic Preemption and Priority Systems*, 2 pp.

*Strobecom I Optical Preemption Detector*, 1 p.

*Strobecom I Preemption Detector Assemblies*, 2 pp.

*Strobecom I Interface Card and Card Cage*, 2 pp.

*The Priority One GPS Concept for Emergency Vehicles*, http://www.mtp-gps.com/concept.html, Priority One GPS, 1 p.

*Priority Once GPS Traffic Preemption Hardware*, http://www.mtp-gps.com/hardware.html, Priority One GPS, 2 pp.

*The Traffic Preemption System for Emergency Vehicles Based on Differential GPS and Two-Way Radio*, http://www.greenf.com/traffic.htm, Greenfield Associates website, 1999, 6 pp.

Zhaosheng Yang and Deyong Guan, *Study on the Scheme of Traffic Signal Timing for Priority Vehicles Based on Navigation System*, 2001 IEEE, pp. 249-254.

Veerender Kaul, *Microwave Technology: Will it Threaten Dominance of Optical Signal Preemption Systems*?, May 8, 2002, 5 pp.

Horst E. Gerland, *Traffic Signal Priority Tool to Increase Service Quality and Efficiency*, Prepared for: APTA Bus Operations Conference 2000, Salem Apr. 2000, 9 pp.

M. Miyawaki, et al., *Fast Emergency Preemption Systems (FAST)*, 1999 IEEE, pp. 993-997.

K. Fox et al., *UTMCO1 Selected Vehicle Priority in the UTMC Environment* (*UTMCO1*),UTMCO1 Project Report 1-Part A, Oct. 19, 1998, 45 pp.

U.S. Department of Transportation, *Advanced Transportation Management Technologies*, Chapter 6, Transit-Management Systems, Publication No. FHWA-SA-97-058, Apr. 1997, pp. 6-1 through 6-23.

J.D. Nelson, et al., *The Modelling of Realistic Automatic Vehicle Locationing Systems for Service and Traffic Control*, Nov. 9, 1995-Nov. 11, 1995, pp. 1582-1587.

*Assessment of the Application of Automatic Vehicle Identification Technology to Traffic Management*, Appendix C: Evaluation of Potential Applications of Automatic Vehicle Monitoring to Traffic Management, Federal Highway Administration, Jul. 1977, 28 pgs.

Robert N. Taube, *Bus Acutated Signal Preemption Systems: A Planning Methodology*, Department of Systems-Design, University of Wisconsin-Milwaukee, May 1976, 120 pgs.

*Assessment of the Application of AutomaticVehicle Identification Technology to Traffic Management*, Federal Highway Administration, JUl. 1977, 44 pgs.

R.M. Griffin and D. Johnson, *A report on the first part of the Northampton Fire Priority Demonstration Scheme-the* [*before*] *study and EVADE*, Crown Copyright 1980, 4 pgs, P.M. Cleal, *Priority for Emergency Vehicles at Traffic Signals*, Civil Engineering Working Paper, Monash University, Dec. 1982, 38 pgs.

P. Davies, et al., *Automatic Vehicle Identification for Transportation Monitoring and Control*, 1986, pgs. 207-224.

N. B. Hounsell, *Active Bus Priority at Traffic Signals*, UK Developments in Road Traffic Signaling, IEEE Colloquiumm May 5, 1988, 5 pgs.

C.B. Harris, et al., *Digital Map Dependent Functions of Automatic Vehicle Location Systems*, 1988 IEEE, pp. 79-87.

P.L. Belcher and I. Catling, *Autoguide-Electronic Route Guidance for London and the U.K.*, 1989 Road Traffic Monitoring, pgs. 182-190.

N. Ayland and P. Davies, *Automatic Vehicle Identification for Heavy Vehicle Monitoring*, 1989 IEEE Road Traffic Monitoring, pp. 152-155.
K. Keen, *Traffic Control at a Strategic Level*, 1989 IEEE Road Traffic Monitoring, pp. 156-160.
K.W. Huddart, *Chapter 7: Urban Traffic Control*, Mobile Information Systems, 1990 Artech House, Inc., 23 pgs.
S. Yagar and E. R. Case, *A Role for VNIS in Real-Time Control of Signalized Networks*?, 1991, pp. 1105-1109.
R.F. Casey, et al.,*Advanced Public Transportation Systems: The State of The Art*, U.S. Department of Transportation, Apr. 1991, 91 pgs.
M.F. McGurrin, et al., *Alternative Architectures for ATIS and ATMS*, IVHS Proceedings, May 1992, pp. 456-467.
A. Ceder and A. Shmilovits, *A Traffic Signalization Control System with Enhancement Information and Control Capabilities*, 1992 Road Transport Informatics Intelligent Vehicle Highway System, pp. 325-333.
*Summary of Findings: Orange County IVHS Review*, Orange County Intelligent Vehicle/Highway Systems Study, JHK & Associates, Aug. 11, 1992, 86 pgs.
*Automatic Vehicle Location/Control and Traffic Signal Preemption Lessons from Europe*, Chicago Transit Authority, Sep. 1992, 140 pgs.
J.D. Nelson et al., *Approaches to the Provision of Priority for Public Transport at Traffic Signals: A European Perspective*, Traffic Engineering Control, Sep. 1993, pp. 426-428.
M. D. Cheslow and S. G. Hatcher, *Estimation of Communication Load Requirements for Five ATIS/ATMS Architectures*, 1993 Proceedings of the IVHS America, pp. 473-479.
M. Kihl and D. Shinn, *Improving Interbus Transfer with Automatic Vehicle Location Year One Report*, Aug. 1993, 35 pgs.
Bernard Held, *Bus Priority: A Focus on the City of Melbourne*, Aug. 1990, Monash University, pp. 157-160, and 180-189.
Gunnar Andersson, article entitled *Fleet Management in Public Transport*, The 3rd International Conference on Vehicle Navigation & Information Systems, Oslo, Sep. 2-4, 1992, pp. 312-317.
James R. Helmer, *Intelligent Vehicle Highway Systems at Work in San Jose, California*, pp. 345-347.
Horst E. Gerland, *ITS Intelligent Transportation System: Fleet Management with GPS Dead Reckoning, Advanced Displays, Smartcards, etc.*, IEEE-IEE Vehicle Navigation & Information Systems Conference, Ottawa - VNIS '93, pp. 606-611.
Robert F. Casey, M.S., Lawrence N. Labell, M.S., *Evaluation Plan for AVL Implementation in Four U.S. Cities*, May 17-20, 1992 IVHS America Proceedings, 11 pgs.
N.B. Hounsell and M. McDonald, Contractor Report 88, Transport and Road Research Laboratory, Department of Transport, *Bus priority by selective detection cover*, p. 8, p. 22.
David A. Blackledge et al., *Electronic Passenger Information Systems - Do They Give the Public What They Want?*, PTRC 19th Summer, Sep. 9-13, 1991 Annual Meeting, pp. 163-176.
American City & County Website, http://www.americancityandcounty.com, *City uses technology to track buses, emergency vehicles*, Jun. 1, 2001, 1 pg.
A. Kirson et al., *The Evolution of ADVANCE*, Development and Operational Test of A Probe-Based Driver Information System in an Arterial Street Network: a Progress Report, The 3rd International Conference on Vehicle Navigation & Information Systems, pp. 516-517.
Volume Two, The Proceedings of the 1992 Annual Meeting of IVHS America, Surface Transporation and the Information Age, May 17-20, 1992, Newport Beach, CA, 13 pgs.
Labell et al., *Advanced Public Transportation Systems: The State of the Art, Update '92*, U.S. Department of Transportaion Federal Transit Administration, 97 pgs.
Stearns et al., *Denver RTD's Computer Aided Dispatch/Automatic Vehicle Location System: the Human Factors Consequences*, U.S. Department of Transportation, Federal Transit Administration, Sep. 1999, 82 pgs.
APTS Project Summaries, http://www.itsdocs.fhwa.dot.gov, *Advanced Public Transportation Systems (APTS) Project Summaries*, Jun. 1996, Office of Mobility Innovation, 33 pgs.
Brendon Hemily, PhD., *Automatic Vehicle Location in Canadian Urban Transit; a Review of Practice and Key Issues*, Dec. 1988, AATT Conference Feb. 1989, pp. 229-233.
Canadian Urban Transit Association, *Proceedings, The International Conference on Automaitc Vehicle Location in Urban Transit Systems*, Sep. 19-21, 1988, Ottawa, Canada, 17 pgs.
1991 TAC Annual Conference, *Proceedings*, vol. 4, Transportation: Toward a Better Environment, 21 pgs.
Casey et al., *Advanced Public Transportation Systems: The State of the Art*, U.S. Department of Transportation Urban Mass Transportation Administration, Component of Departmental IVHS Initiative, Apr. 1991, 91 pgs.
U.S. Department of Transportation, *German "Smart-Bus" Systems, Potential for Application in Portland, Oregon, Volume 1, Technical Report*, Jan. 1993, Office of Technical Assistance and Safety, Advanced Public Transportation Systems Program, A Component of the Departmental IVHS Initiative, 107 pgs.
Arup, *Traffic Management for Bus Operations Main Report*, Prepared by Ove Arup Transportation Planning for the Public Transport Corporation, Dec. 1989, 123 pgs. (front and back).
Randy D. Hoffman, et al. *DGPS, IVHS Drive GPS Toward Its Future*, GPS World Showcase, Dec. 1992, 1 pg.
Ivan A. Getting, *Getting-The Global Positioning System*, IEEE Spectrum, Dec. 1993, pp. 37-38, 43-47.
IVHS Study - Strategic Plan, Centennial Engineering, Inc., p.31.
Horst E. Gerland, FOCCS - *Flexible Operation Command and Control System for Public Transport*, PTRC 19th Summer Sep. 9-13, 1991 Annual Meeting, pp. 139-150.
L. Sabounghi et al., *The Universal Close-Range Road/Vehicle Communication System Concept The Numerous Applications of the Enhanced AVI*, 1991 TAC Annual Conference, pp. A41, A43-A62.
R.L. Sabounghi, *Intelligent Vehicle Highway System - The Enhanced AVI and Its CVO Applications*, 1991, VNIS '91, Vehicle Indication and Information Systems Conference Proceedings, pp. 957-967
Clarioni, et al., *Public Transport Fleet Location System Based on DGPS Integrated with Dead Reckoning*, Road Vehicle Automation, Jul. 12, 1993, pp. 259-268.

* cited by examiner

TRAFFIC PREEMPTION SYSTEM

CROSS-REFERENCE TO RELATED APPLICATIONS

The present invention claims priority from U.S. Provisional Application Ser. No. 60/510,603 the disclosure of which is incorporated herein by reference. This application is also a continuation-in-part of U.S. application Ser. No. 10/811,075, filed on Mar. 24, 2004 which is a continuation-in-part of U.S. Pat. No. 6,940,422, filed on Aug. 15, 2003 which in turn claims the benefit of U.S. Provisional Application Ser. No. 60/403,916, filed on Aug. 15, 2002.

BACKGROUND OF THE INVENTION

The present invention relates generally to traffic preemption systems and more specifically to a preemption system in which intersection preemption is handled by a centralized control facility. The present invention is related to U.S. patent application Ser. No. 10/811,075, the disclosure of which is incorporated herein by reference in its entirety Traffic signals are typically determined by an intersection controller. Information is often communicated between intersection controllers and a centralized traffic management center via a fixed or wireless network. The network can be used to coordinate the timing of signals generated by various intersection controllers and to receive diagnostic information from intersection controllers.

Preemption systems are widely used to provide transit and emergency vehicles with the capability of disrupting a regular sequence of traffic signals in order to provide right of way through an intersection. Preemption systems can decrease the time taken for emergency vehicles to reach the scene of an accident/incident and/or ensure a greater likelihood of a transit vehicle maintaining its schedule. Preemption systems can use a variety of techniques to inform intersections that a preempting vehicle is approaching an intersection. Some systems use direct communication techniques such as optical or audio signals. Other systems locate the position of the preempting vehicle and communicate this information to intersection controllers via a wireless network. The intersection controller can then determine whether to preempt the traffic signals of the intersection and the timing of the preemption. A positioning system such as the global positioning system (GPS) can be used to estimate the position of a preempting vehicle. The accuracy with which the position of a vehicle is estimated can also be improved using map matching techniques.

Fleet management systems are commonly used to track the location of vehicles and provide diagnostic information to a centralized fleet management center. Fleet management systems can be useful in determining the location of resources and identifying vehicles that require maintenance before problems with the vehicle are manifest. Fleet management systems can also use GPS receivers to estimate vehicle position. This information in addition to onboard diagnostic information can then be transmitted to a control center via a wireless network.

SUMMARY OF THE INVENTION

Embodiments of the present invention combine onboard equipment mounted on a vehicle with fleet management centers, traffic management centers and intersection controllers to enable vehicles to preempt intersections indirectly by sending communications via a fleet management center and a traffic management center to the intersection controller. In one embodiment, the invention includes a vehicle equipped with an onboard computer system capable of capturing diagnostic information, estimating the location of the emergency vehicle using information provided by a GPS receiver connected to the onboard computer system and transmitting the captured diagnostic information and estimated location using a wireless transmitter connected to the onboard computer system via a first wireless network. The embodiment also includes a fleet management computer system connected to a wireless receiver, where the fleet management computer system and wireless receiver are capable of receiving information transmitted by the on-board equipment, determining whether the received information is from a vehicle requiring intersection preemption and providing the estimated location of vehicles requiring intersection preemption to a traffic management computer system. The traffic management computer system is capable of receiving estimated locations of vehicles requiring intersection preemption from the fleet management computer system and forwarding preemption requests to intersection controllers via a second network.

In a further embodiment, the fleet management computer system and the traffic management computer system are implemented on a single computer system. Alternatively, the fleet management computer system and the traffic management computer system are implemented using separate computer systems that are connected via a third network and the second and third networks are implemented using the same network.

In another embodiment, the fleet management computer system is connected to the wireless receiver via a fourth network and the second and fourth networks are implemented using the same network.

In a still further embodiment, the diagnostic information includes information concerning whether the vehicle is in a "mode" where it requires intersection preemption. In addition, the diagnostic information can include information concerning the priority of the vehicle.

In yet another embodiment, the traffic management computer system is also configured to resolve conflicts between the preemption requirements of vehicles requiring intersection preemption.

In a still further embodiment again, the fleet management computer system includes a register of vehicles and an assigned priority associated with each vehicle, the fleet management computer system is configured to determine the priority of a vehicle requiring intersection preemption and the fleet management computer system is configured to provide the priority of the vehicle requiring intersection preemption in addition to the estimated location of the vehicle requiring intersection preemption to the traffic management computer system.

In yet another embodiment again, the traffic management computer system is configured to identify conflicts between the preemption requirements of the vehicles requiring intersection preemption and the traffic management computer system is configured to resolve the conflict by sending the required preemption requests for the vehicle with the highest priority.

In still yet another embodiment, the traffic management computer system forwards the estimated location of the vehicle requiring intersection preemption and the priority of the vehicle to the intersection controller as part of the preemption request and the intersection controller includes an add-on module capable of receiving the estimate position and the priority information of the vehicle requiring intersection preemption and resolving conflicts with other preemption requests by honoring the preemption request of the highest priority vehicle.

In still yet another further embodiment, the onboard computer system uses map matching to estimate the location of the vehicle. Alternatively, the fleet management computer system uses map matching to improve the estimate of the location of the vehicle or the traffic management computer system uses map matching to improve the estimate of the location of the vehicle.

In still yet another further embodiment again, the intersection controller includes an on-odd module configured to receive an estimated location of a vehicle position as part of a preemption request and to improve on the estimation by performing map matching.

An embodiment of the method of the invention includes estimating the location of at least one vehicle, providing the estimated location to a fleet management system, determining whether any of the vehicles require the preemption of an intersection, forwarding the estimated location of vehicles requiring preemption to a traffic management system and sending a preemption request to an intersection controller in satisfaction of the preemption requirements of at least one of the vehicles.

Another embodiment of the method of the invention includes resolving conflicts between the preemption requirements of multiple vehicles.

A still further embodiment of the method of the invention includes assigning priorities to vehicles and resolving conflicts between the preemption requirements of multiple vehicles by honoring the preemption requirements of the highest priority vehicle.

Yet another embodiment of the method of the invention includes estimating vehicle location using information obtained using a GPS receiver.

A still further embodiment again of the method of the invention includes estimating vehicle location using map matching.

DETAILED DESCRIPTION OF THE INVENTION

Embodiments of the present invention include onboard equipment, fleet management centers, traffic management centers and intersection controllers. Information from the onboard equipment is communicated to the fleet management centers via a wireless network. The fleet management centers use the information from the onboard equipment to perform fleet management functions. The fleet management centers also determine whether preemption of intersections is required. If preemption is required, then the fleet management center forwards information concerning the vehicles requiring preemption to the traffic management center. The traffic management center determines whether to honor the preemption requests. If the traffic management center determines that an intersection should be preempted, then the traffic management center forwards a preemption request to the intersection controller via a wireless or wired network. The intersection controller receives the preemption request and preempts the intersection in accordance with the preemption request. All of the above actions are performed in real time so that there is only a small latency between the receipt of vehicle information by the fleet management center and the communication of a preemption request to an intersection controller. In several embodiments, the fleet management center and the traffic management center are combined into a single management center. Some embodiments also utilize additional hardware to enable intersection controllers that are not configured to receive preemption requests from a traffic management center to be preempted.

Figure 1:
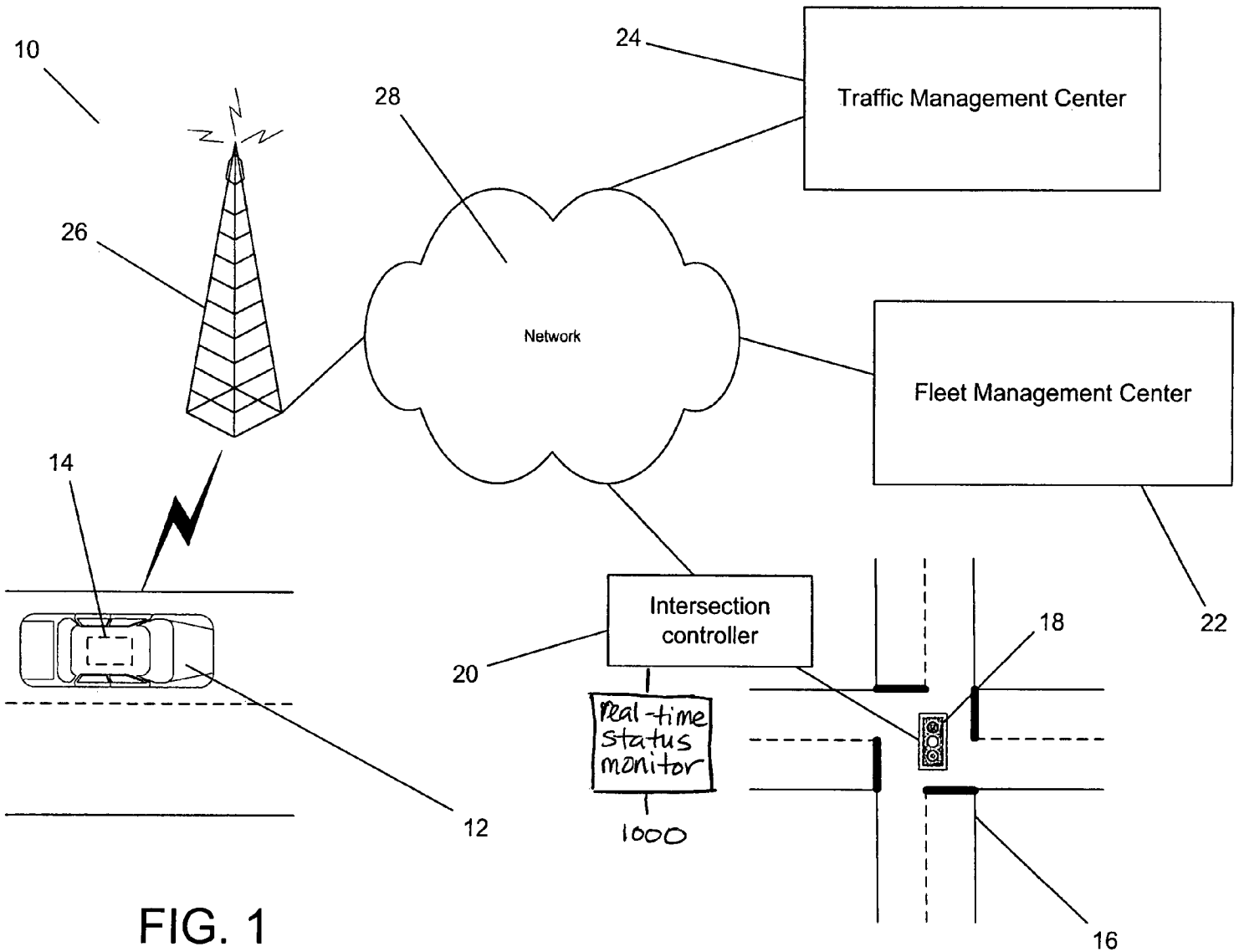
FIG. 1 is a schematic diagram of a centralized preemption system in accordance with an embodiment of the present invention.

Turning now to the figures, FIG. 1 shows a centralized preemption system in accordance with an embodiment of the present invention. The preemption system 10 includes at least one emergency vehicle 12 equipped with onboard equipment 14. At least one intersection 16, where traffic signals 18 at the intersection are controlled by an intersection controller 20. The system also includes a fleet management center 22 and a traffic management center 24. The onboard equipment and the fleet management center are in communication. The fleet management center and the traffic management center are in communication and the traffic management center and the intersection controller are in communication. In one embodiment, the onboard equipment and the fleet management center communicate via a wireless network that includes a wireless base station 26, which is connected to the fleet management center via a wide area network 28. In addition, the fleet management center can be in communication with the traffic management center via a wired or wireless network and the traffic management center can be in communication with the intersection controller via a wired or wireless network.

According to one embodiment of the invention, the intersection controller 20 is coupled to a real-time status monitor 1000. The real-time status monitor verifies that all "red" lights are activated and sends an "intersection preempted" signal to the intersection controller. The intersection controller 20 in turn relays that information to emergency vehicles.

Figure 2:
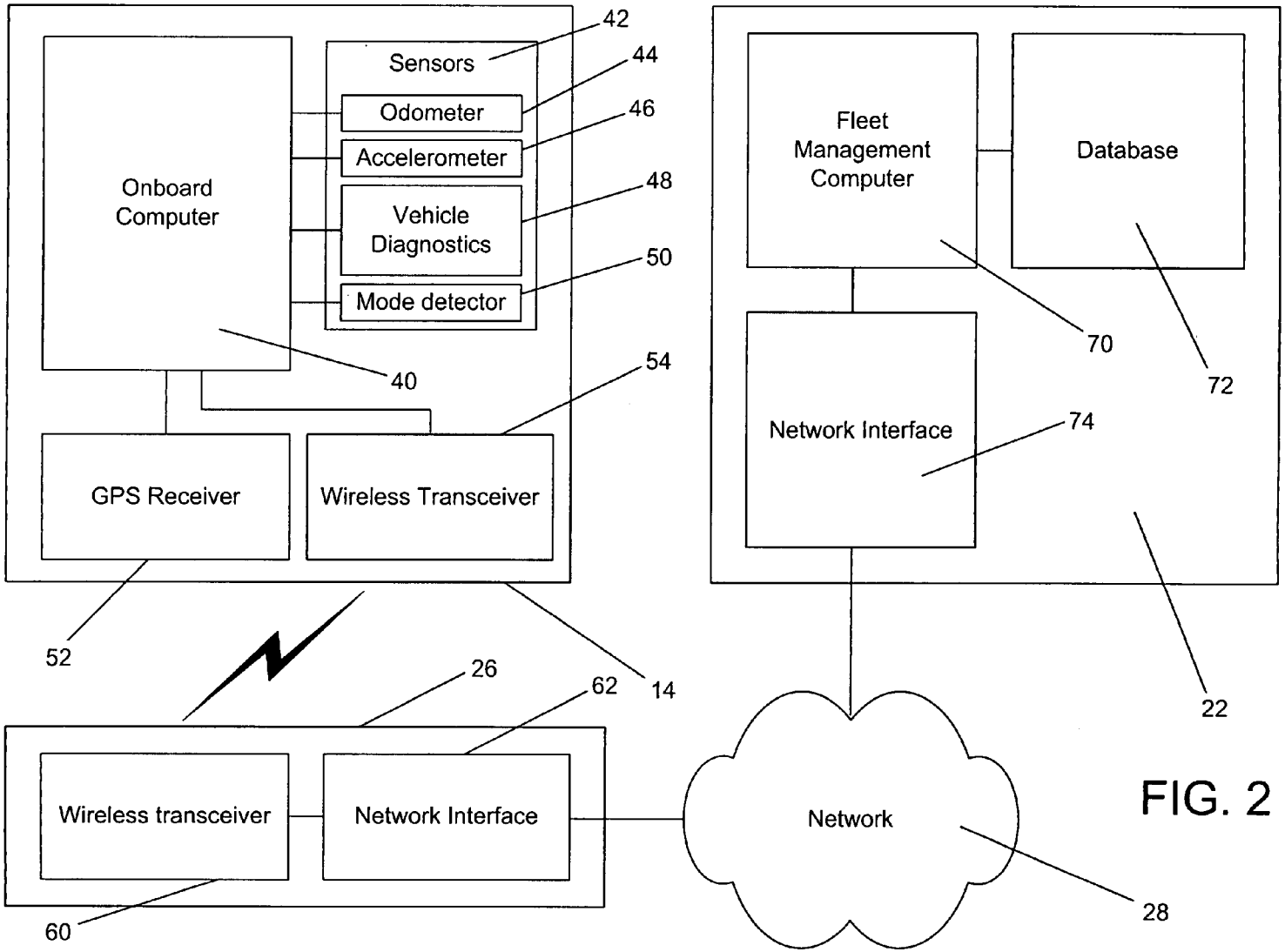
FIG. 2 is a schematic diagram of onboard equipment in communication with a fleet management center in accordance with an embodiment of the present invention.

Onboard equipment 14 in communication with a fleet management center 22 in accordance with the present invention is illustrated in FIG. 2. The onboard equipment 14 includes an onboard computer 40 that is connected to a variety of sensors 42. In one embodiment, the sensors can include an odometer or other speed sensor 44 and an accelerometer 46. The sensors can also include a variety of sensors that monitor the vehicle diagnostics 48 and a sensor that monitors whether the vehicle is in preemption mode 50. The sensors are also likely to include a sensor (not shown) for determining the heading of the vehicle. The onboard computer is also connected to a GPS receiver 52 and a wireless transceiver 54. The GPS receiver provides the onboard computer with information concerning the position of the vehicle. The sensors can provide additional information enabling the prediction of estimated times of arrival. The onboard computer communicates with external devices using the transceiver. The transceiver can be used to transmit information obtained from the GPS receiver and the sensors to a fleet management center.

In one embodiment, the onboard computer is an embedded vehicle computer, such as an OBD (On Board Diagnostics) II standard computer. In another embodiment, the onboard computer may take the form of a portable, standard electronic device such as a cell phone or Personal Digital Assistant (PDA). In other embodiments, other devices with processing and input/output capabilities can be used as an onboard computer.

In one embodiment, the GPS receiver can be any of the OEM GPS circuit or digital chips manufactured by Garmin International Inc. of Olathe, Kans. In another embodiment, the GPS receiver can be embedded in electronics within the vehicles, such as GPS capable cell phones. In other embodiments, other GPS receivers or devices capable of estimating position can be used.

In one embodiment, the wireless transceiver is a spread spectrum radio transceiver made by Freewave Technologies, Inc. of Boulder, Colo. In other embodiments, other wireless communication equipment can be used.

As discussed above, the onboard equipment communicates with the fleet management center via a wireless network. In one embodiment, the fleet management center is connected to one or more wireless base stations 26 via a network 28. Each base station can include a wireless transceiver 60 and a network interface 62. The wireless transceiver communicates with other devices over the wireless network and the network interface relays these communications to and from other devices via the fixed network.

The fleet management center includes a fleet management computer 70 connected to a database 72 and a network interface 74. The fleet management computer handles in real time information received from the wireless base stations via the network. The database contains information concerning the roadways and the vehicles that form the fleet being managed. The fleet management computer matches in real time information received from a vehicle with information concerning the vehicle contained in the database. The fleet management computer also determines in real time which vehicles require intersection preemption and forward information concerning the vehicle to a traffic management center via the network using the network interface. This information can include the type of vehicle, the level of priority, the position of the vehicle, the heading of the vehicle, the speed of the vehicle, the acceleration of the vehicle and other data affecting priority needs. In addition to functions related to preemption, the fleet management center can also serve as an emergency call center and provide information to vehicles advising them of the best route to a destination. Furthermore, route selection can be informed by the ability of the overall system to guarantee intersection preemption along the route.

In one embodiment, the fleet management computer is a standard IBM-compatible personal computer with a standard operating system such as Windows NT manufactured by Microsoft Corporation of Redmond, Wash. In other embodiments other devices with processing and input/output capabilities can be used as a fleet management computer.

In one embodiment, the database is an ODBC compatible database, such as Microsoft Access. In other embodiments, other database systems can be used.

In one embodiment, the network interface is a TCP/IP network adapter. In other embodiments, other network interfaces appropriate to the nature of the network 28 can be used.

As described above, the onboard equipment uses the sensors to obtain information concerning the state of the vehicle. This information is communicated to the fleet management center via the wireless network. The sensor information can include information concerning whether the vehicle is in a "mode" requiring the preemption of intersections. Vehicles such as mass transit vehicles may always require preemption when in service, whereas emergency vehicles may only require intersection preemption when responding to an emergency. The onboard equipment uses the GPS receiver to estimate the position of the vehicle. In one embodiment, the position estimate is communicated to the fleet management center via the wireless network. In other embodiments, the onboard equipment is capable of performing map matching. Map matching is a technique used to improve an estimation of vehicle position by fitting a GPS reading or series of GPS readings to a road map. Theoretically the position of the vehicle is constrained such that it must be located on a road. Therefore, an estimation that places a vehicle in a location that is not part of a road can be improved. In one embodiment, such an estimate would be improved by modifying the estimate to indicate the vehicle's position as being on the road closest to the GPS estimate. In other embodiments, additional information such as the trajectory of the vehicle can be matched with road information. In embodiments where the onboard computer performs map matching, the onboard equipment can also include a database containing roadway information.

As described above, the fleet management center receives information from the onboard equipment and performs fleet management functions based on this vehicle information. In embodiments, where the vehicle information includes information concerning whether the vehicle is in a "mode" requiring intersection preemption, then position of the vehicle can be forwarded to the traffic management center with an instruction indicating that the vehicle requires preemption of intersections in its path. The fleet management center can also serve as a repository for information concerning the priority of a vehicle. A priority can be assigned to every vehicle in the fleet and the priority for each vehicle stored in the database. Priority information can help traffic management centers resolve conflicting preemption requests. In embodiments where all vehicles have the same priority, then simply providing location information can be sufficient.

In embodiments where the onboard equipment uses sensors that can obtain information concerning the heading, speed and acceleration of a vehicle, this information can also be provided to the traffic management center to enable the traffic management center to calculate estimated times of arrival at particular locations for the vehicle requesting preemption.

In embodiments where the onboard equipment does not perform map matching, either the fleet management center or the traffic management center can perform map matching based on the vehicle location estimate provided to the fleet management center by the onboard equipment and optionally additional information such as the heading, speed and/or acceleration of the vehicle.

Figure 3:
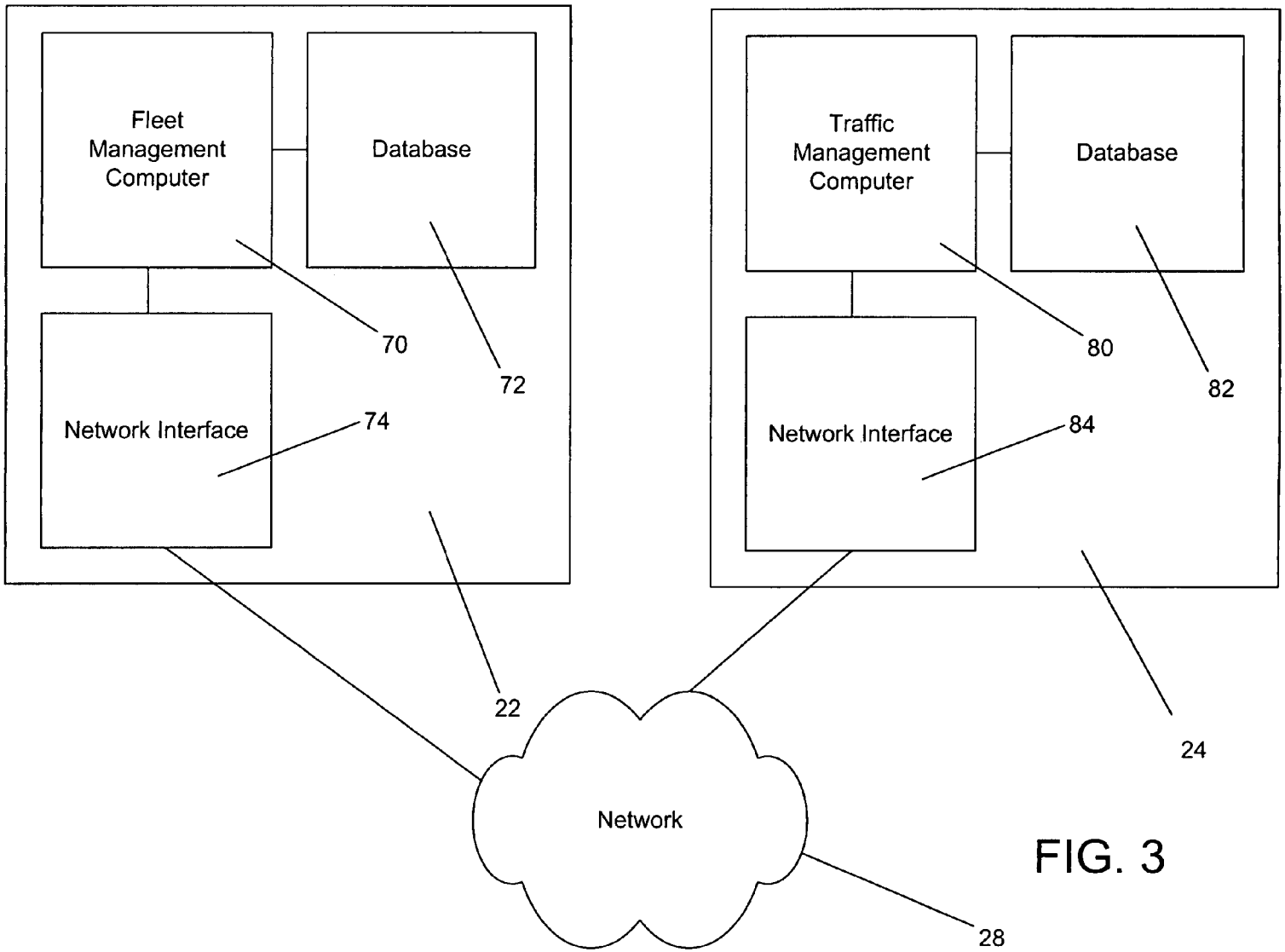
FIG. 3 is a schematic diagram of a fleet management center communicating with a traffic management center in accordance with an embodiment of the present invention.

A fleet management center in communication with a traffic management center is illustrated in FIG. 3. The fleet management center 22 is typically connected to the traffic management center 24 using the network 28. In other embodiments, a separate network is provided to enable communication between the fleet management center and the traffic management center. Preferably the networking technology connecting the fleet management center and the traffic management center provide a significant level of security to prevent monitoring of communications or tampering with traffic signals. The traffic management center includes a traffic management computer 80 connected to a database 82 and a network interface 84. The traffic management computer receives information from intersection controllers and fleet management centers provided to it via the network interface. The traffic management center maintains a database concerning roadways and intersections. The traffic management center receives information concerning the position and optionally the priority, heading, speed and acceleration of vehicles that require intersection preemption. The traffic management computer uses this information and information in the database concerning the sequence of each intersection controller to determine in real time the preemption requests, if any, that should be sent to intersection controllers via the network.

In one embodiment, the traffic management computer is a standard PC, enabled with traffic management center (TMC) software such as the Actra application manufactured by Siemens of Munich, Federal Republic of Germany. In other embodiments other devices with processing and input/output capabilities can be used as an onboard computer.

In one embodiment, the database is a ODBC compatible database. In other embodiments, other database systems can be used.

In one embodiment, the network interface is a TCP/IP network adapter. In other embodiments, other network interfaces appropriate to the nature of the network 28 can be used.

As discussed above, the fleet management center provides the traffic management center with information concerning the location of a vehicle that is in a "mode," where it requires intersection preemption. The fleet management center can also provide the traffic management center with information concerning the priority of the vehicle. The traffic management center uses this information to identify intersections requiring preemption and the time at which these intersections should be preempted based on the heading, speed and acceleration of the vehicle. In embodiments where heading, speed and acceleration information are not available directly from the vehicle, this information can be determined by the traffic management center by monitoring the position of the vehicle over time.

In embodiments of the invention where the traffic management center is responsible for resolving conflicts between preemption requests, the traffic management center evaluates in real time whether the preemption needs of a particular vehicle can be honored. If a higher priority vehicle requires preemption of the same intersection, then the preemption request cannot be honored. Otherwise, the traffic management center sends a preemption request to the intersection controllers controlling the intersections requiring preemption and the preemption request is timed or includes information that ensures that the intersection controller preempts the intersection in the required manner and at the required time.

Figure 4:
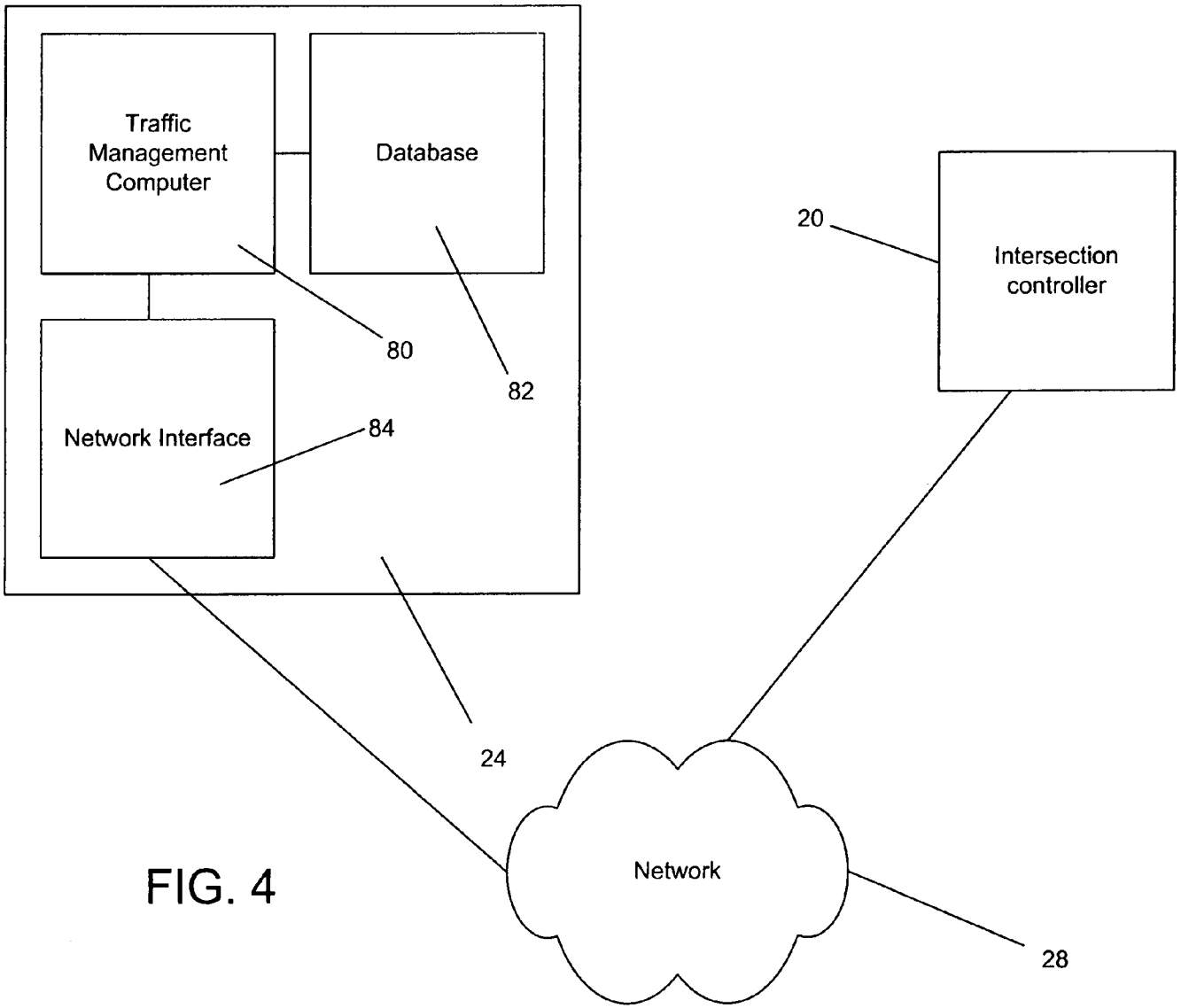
FIG. 4 is a schematic diagram of a traffic management center in communication with an intersection controller in accordance with an embodiment of the present invention.

An intersection controller that is in communication with a traffic management center in accordance with an embodiment of the present invention is illustrated in FIG. 4. The traffic management center 22 can be connected to the intersection controller 20 via the network 28. In other embodiments, a separate network is used for communications between the traffic management center and the intersection controllers. In these embodiments, any wired or wireless networking technology can be used to transmit the communications. In the illustrated embodiment, the intersection controller is a Siemens M52 controller. In other embodiments, the intersection controller can be any intersection controller capable of controlling intersection signals in a manner that can be preempted.

As discussed above, the traffic management center sends preemption requests to the intersection controller. The nature of the preemption requests is largely dependent on the nature of the intersection controller. If the intersection controller is only capable of immediately responding to a preemption request, then the preemption request must be sent when preemption is required. More intelligent intersection controllers can receive preemption requests including information concerning when the preemption request should be implemented.

Figure 5:
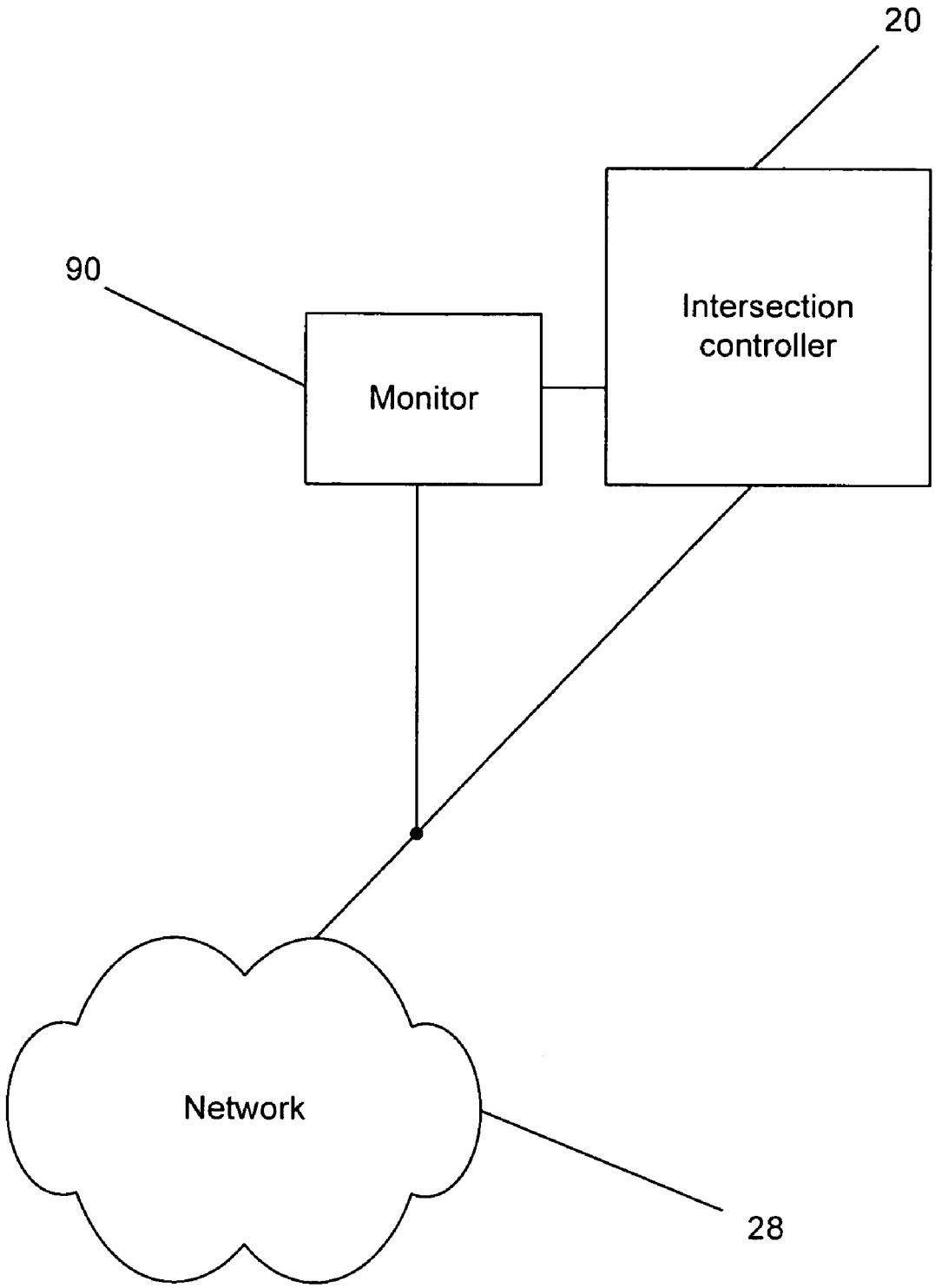
FIG. 5 is a schematic diagram of an intersection controller connected to a preemption module in accordance with an embodiment of the present invention.

An intersection controller connected to an add-on monitor is illustrated in FIG. 5. In one embodiment, an add-on monitor 90 monitors the network and directly preempts the intersection controller. In embodiments where all of the intersection controllers connected to the traffic management center include add-on monitors, estimation of the time at which a vehicle will arrive at the intersection and/or resolution of conflicting preemption requests can be performed by the add-on monitor instead of or in addition to by the traffic management center.

In another embodiment, the add-on monitor receives position information heading, speed and/or acceleration information as part of the preemption request from the traffic management center. The position information and speed information can be used by the add-on monitor to determine the timing of the preemption of the intersection. In several embodiments, this decision can involve consideration of the sequence of the traffic signals in a manner similar to that described in U.S. patent application Ser. No. 10/811,075.

Figure 6:
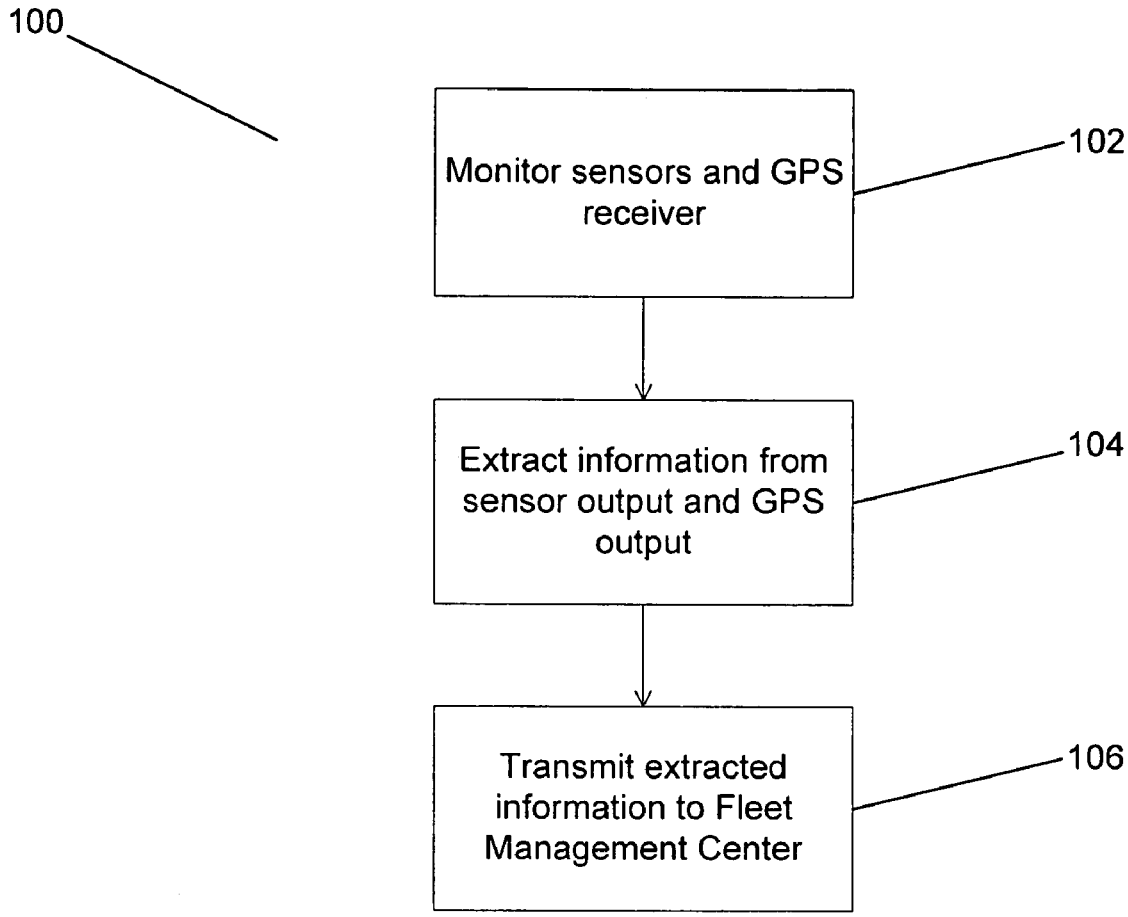
FIG. 6 is a flow diagram illustrating a method used by onboard equipment to acquire information and transmit it to a fleet management center in accordance with an embodiment of the present invention.

A process in accordance with the present invention that can be used by onboard equipment to obtain diagnostic information and position information is illustrated in FIG. 6. The process 100 includes monitoring (102) sensors and the outputs of a GPS receiver to obtain information concerning the position of a vehicle. In one embodiment, the sensor information can provide heading, speed and acceleration information. Information is extracted (104) from the sensor outputs and the GPS outputs. The extracted information is then provided (106) to a fleet management center.

Figure 7:
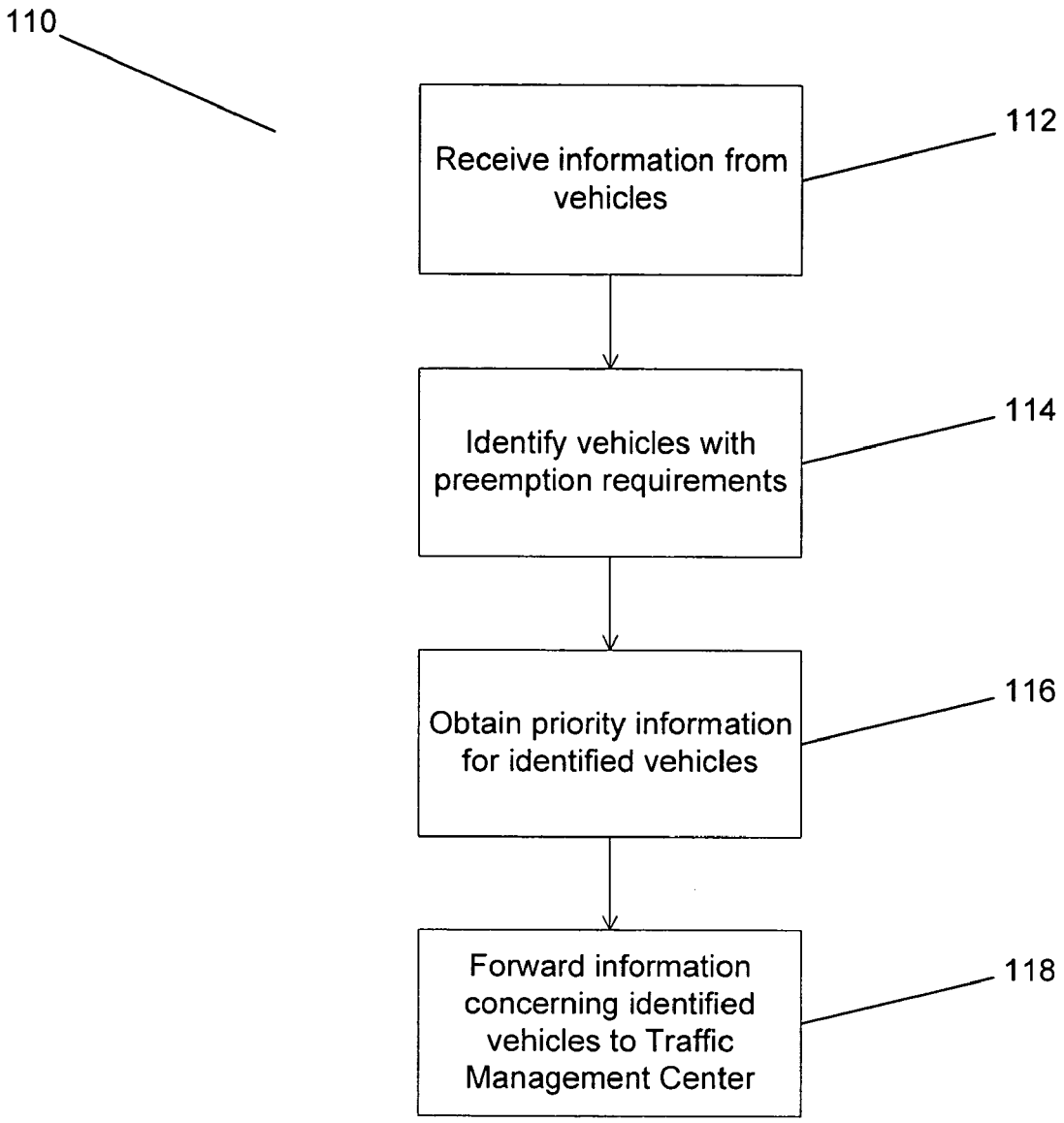
FIG. 7 is a flow diagram illustrating a method used by a fleet management center to process and forward information from an emergency vehicle's onboard equipment to a traffic management center in accordance with an embodiment of the present invention.

A process in accordance with the present invention that can be used by the fleet management center to receive information from onboard equipment of emergency vehicles and forward preemption requests to a traffic management center is illustrated in FIG. 7. The process 110 includes receiving (112) information from a vehicle. Identifying (114) vehicles with preemption requirements and their locations with the assistance of the information provided by the vehicles. In addition, priority information is obtained (116) concerning the vehicles. Information concerning the identified vehicles and their priorities is forwarded (118) to a traffic management center.

Figure 8:
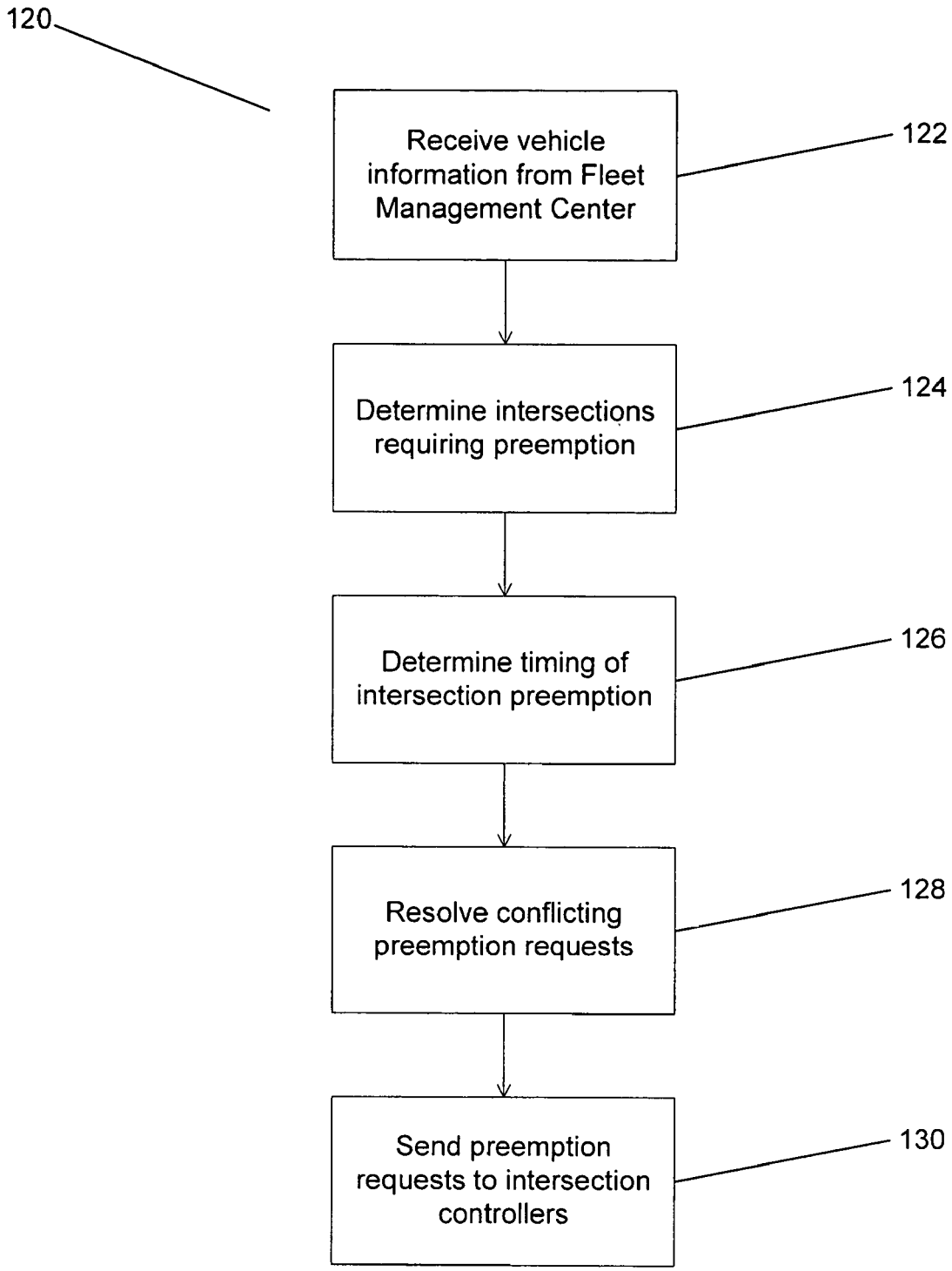
FIG. 8 is a flow diagram illustrating a method used by a traffic management center to evaluate information received from a fleet management center and determine whether preemption requests should be sent to intersection controllers in accordance with an embodiment of the present invention.

A process in accordance with the present invention that can be used by a traffic management center to receive preemption requests, resolve conflicts between preemption requests and send signals to preempt intersections is illustrated in FIG. 8. The process 120 includes receiving (122) vehicle information from a fleet management center. Determining intersections requiring preemption (124), determining the timing of the intersection preemption (126) and resolving (128) conflicts between preemption requests. The preemption requests are then sent (130) to intersection controllers. In one embodiment, determining the timing of the intersection preemption includes determining the time required to clear the intersection of pedestrians. In addition, preemption conflicts can be resolved by honoring the preemption request of the highest priority vehicle.

Figure 9:
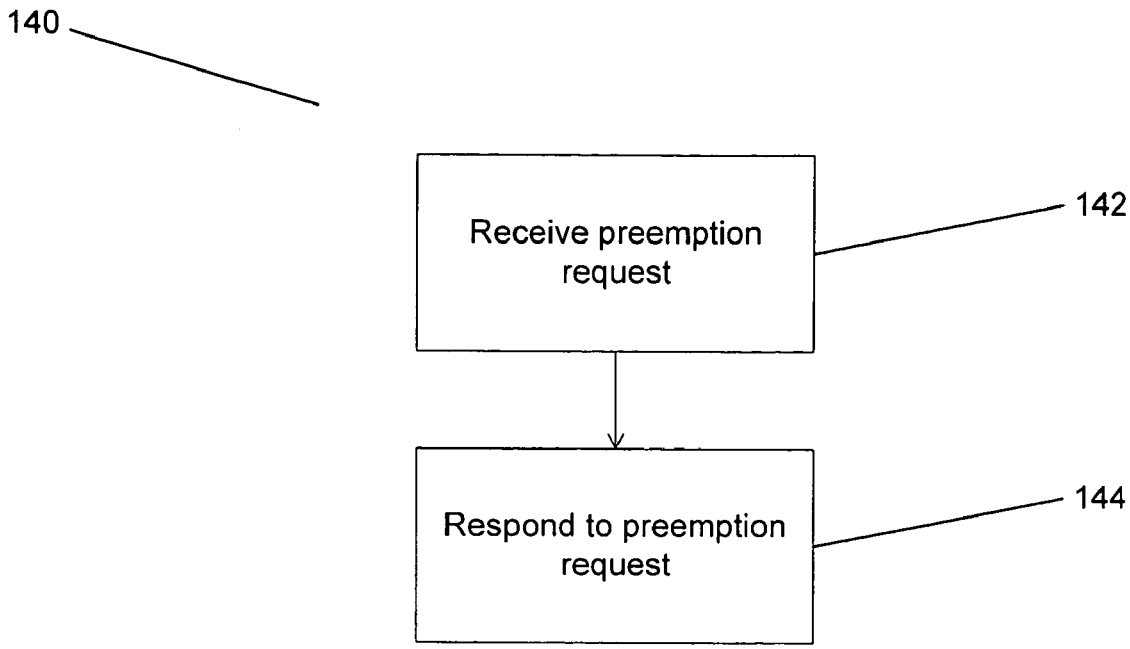
FIG. 9 is a flow diagram illustrating a method used by an intersection controller to respond to a preemption request received from a traffic management center in accordance with an embodiment of the present invention.

A process in accordance with the present invention that can be used by an intersection controller to respond to a preemption request sent from a traffic management center is illustrated in FIG. 9. The process 140 includes receiving (142) a preemption request and responding (144) to the preemption request by preempting the intersection. In one embodiment, the preemption request is responded to by clearing the intersection of pedestrians and then at an appropriate time preempting the traffic signals. In addition, warning indicators can be used to indicate the direction from which the preempting vehicle is approaching the intersection.

Figure 10:
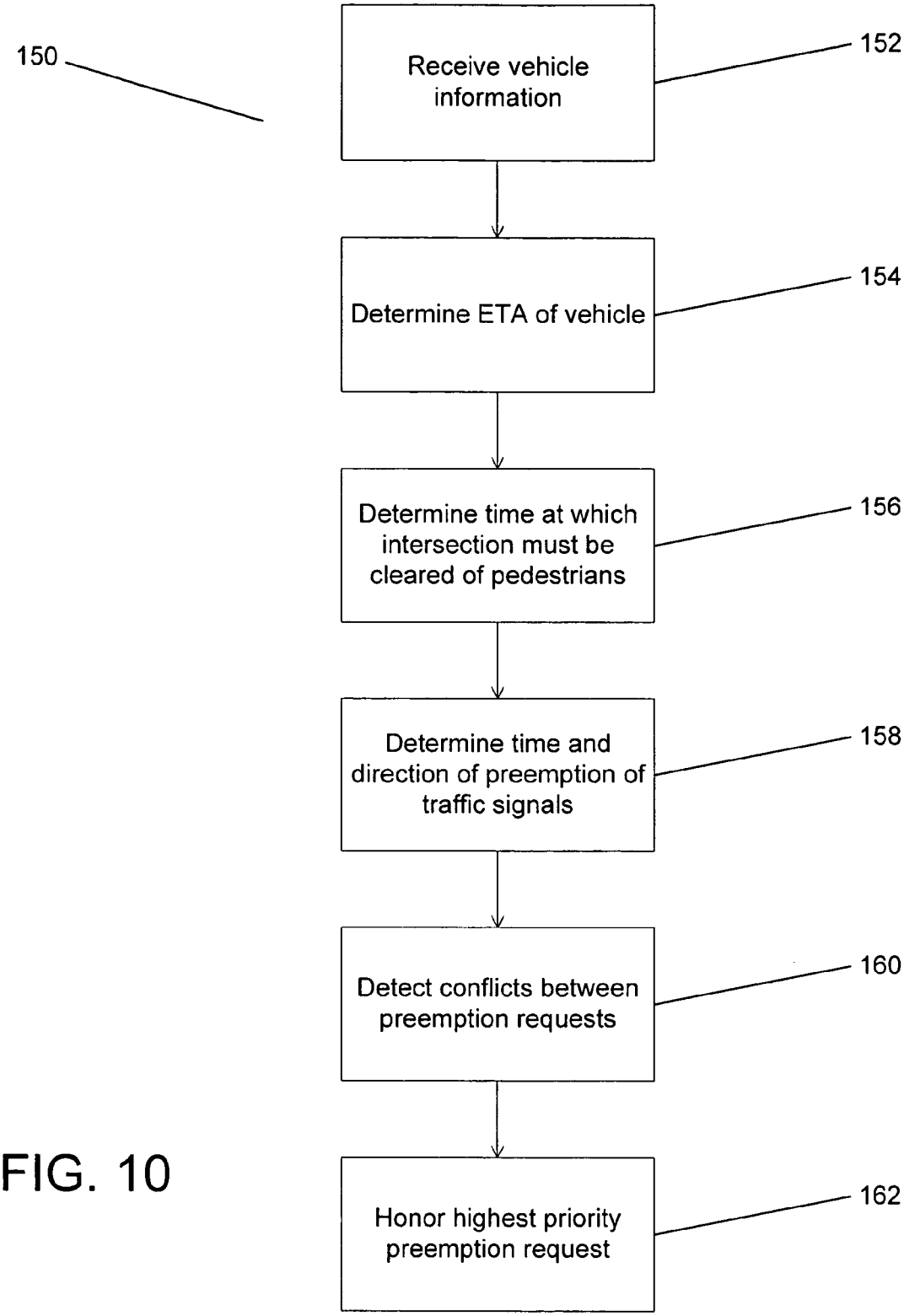
FIG. 10 is a flow diagram illustrating a method used by an intersection controller to respond to a preemption request received from a traffic management center in accordance with an embodiment of the present invention that includes information concerning the location and priority of the vehicle.

Another process in accordance with the present invention that can be used by an intersection controller to respond to a preemption request sent by a traffic management center, which includes emergency vehicle position and speed information, is illustrated in FIG. 10. The process 150 includes receiving vehicle information (152) and determining (154) the estimated time of arrival (ETA) of the vehicle at the intersection. Once the ETA has been calculated, determining (156) the time in advance of the vehicle's arrival at which the intersection controller must preempt the pedestrian signals to clear the intersection of pedestrians and determining (158) the time at which the intersection controller should preempt the traffic signals to provide the inbound vehicle with right of way. Based on the calculated times, conflicts with other preemption requests can be detected (160). Any conflict can be resolved by honoring (162) the highest priority preemption request.

While the above description contains many specific embodiments of the invention, these should not be construed as limitations on the scope of the invention, but rather as an example of one embodiment thereof. As indicated above, map matching and the resolution of conflicts between preemption requests can be performed at a variety of locations within the system. An important aspect of the system is the real time flow of information throughout the components of the system. Therefore, one of ordinary skill in the art can appreciate that a system in accordance with the present invention can be designed, where the various functions of the preemption systems described above can be performed by any of the various components of the system and in any of a variety of locations within the system. In addition, the examples provided above include a single fleet management center and a single traffic management center. Embodiments of the present invention can include multiple fleet management centers and multiple traffic management centers. In such systems information would be routed between the fleet management and traffic management centers appropriate for the geographic location of the emergency vehicle and the geographic location of any intersections requiring preemption. Alternatively, a system in accordance with the present invention can include a single center that performs both fleet management and traffic management functions. Such a center in accordance with the present invention would communicate with both onboard equipment and with intersection controllers.

Furthermore, the embodiments provided above indicate various examples of hardware that can be utilized to implement a system in accordance with the present invention. One of ordinary skill in the art would appreciate that almost any system with fleet management capabilities, which include vehicle location, can be used in accordance with the present invention in conjunction with almost any traffic management system, where the traffic management system is in communication with intersection controllers. In addition, one of ordinary skill in the art would appreciate that a system in accordance with the present invention can be used in conjunction with a conventional preemption system. Accordingly, the scope of the invention should be determined not by the embodiments illustrated, but by the appended claims and their equivalents.

What is claimed is:

1. A traffic preemption system, comprising:

a vehicle equipped with an onboard computer system configured to:

capture diagnostic information;

estimate the location of the emergency vehicle using information provided by a GPS receiver connected to the onboard computer system; and transmit the captured diagnostic information and estimated location using a wireless transmitter connected to the onboard computer system via a first wireless network;

a fleet management computer system connected to a wireless receiver, where the fleet management computer system and wireless receiver are configured to:

receive information transmitted by the on-board equipment;

determine whether the received information is from a vehicle requiring intersection preemption;

provide the estimated location of vehicles requiring intersection preemption to a traffic management computer system configured to receive estimated locations of vehicles requiring intersection preemption from the fleet management computer system, and forward preemption requests;

an intersection controller receiving a preemption request and preempting one or more traffic lights at an intersection in response; and a real-time status monitor verifying preemption of the traffic lights at the intersection.

2. The traffic preemption system of claim 1, wherein:
the fleet management computer system and the traffic management computer system are implemented on a single computer system.

3. The traffic preemption system of claim 1, wherein:
the fleet management computer system and the traffic management computer system are implemented using separate computer systems that are connected via a third network.

4. The traffic preemption system of claim 3, wherein the second and third networks are implemented using the same network.

5. The traffic preemption system of claim 1, wherein the fleet management computer system is connected to the wireless receiver via a fourth network.

6. The traffic preemption system of claim 5 wherein the second and fourth networks are implemented using the same network.

7. The traffic preemption system of claim 1, wherein the diagnostic information includes information concerning whether the vehicle is in a "mode" where it requires intersection preemption.

8. The traffic preemption system of claim 1, wherein the diagnostic information includes information concerning the priority of the vehicle.

9. The traffic preemption system of claim 1, wherein the traffic management computer system is also configured to resolve conflicts between the preemption requirements of vehicles requiring intersection preemption.

10. The traffic preemption system of claim 1, wherein:
the fleet management computer system includes a register of vehicles and an assigned priority associated with each vehicle;
the fleet management computer system is configured to determine the priority of a vehicle requiring intersection preemption; and
the fleet management computer system is configured to provide the priority of the vehicle requiring intersection preemption in addition to the estimated location of the vehicle requiring intersection preemption to the traffic management computer system.

11. The traffic preemption system of claim 10, wherein:
the traffic management computer system is configured to identify conflicts between the preemption requirements of the vehicles requiring intersection preemption; and
the traffic management computer system is configured to resolve the conflict by sending the required preemption requests for the vehicle with the highest priority.

12. The traffic preemption system of claim 10, wherein:
the traffic management computer system forwards the estimated location of the vehicle requiring intersection preemption and the priority of the vehicle to the intersection controller as part of the preemption request; and
the intersection controller includes an add-on module configured to:
receive the estimate position and the priority information of the vehicle requiring intersection preemption; and
to resolve conflicts with other preemption requests by honoring the preemption request of the highest priority vehicle.

13. The preemption system of claim 1, wherein the onboard computer system uses map matching to estimate the location of the vehicle.

14. The traffic preemption system of claim 1, wherein the fleet management computer system uses map matching to improve the estimate of the location of the vehicle.

15. The traffic preemption system of claim 1, wherein the traffic management computer system uses map matching to improve the estimate of the location of the vehicle.

16. The traffic preemption system of claim 1, wherein the intersection controller includes an on-odd module configured to receive an estimated location of a vehicle position as part of a preemption request and to improve on the estimation by performing map matching.

17. A traffic preemption system, comprising:
at least one onboard diagnostic means mounted on a vehicle and connected to a GPS receiver and a wireless transmitter for determining the location of a vehicle and the preemption requirements of the vehicle;
at least one fleet management means connected to a wireless receiver for receiving information concerning the location and preemption requirements of vehicles and for forwarding information concerning vehicles requiring intersection preemption to at least one traffic management means,
the traffic management means for determining the preemption requirements of vehicles based on information provided by the fleet management means and for preempting at least one intersection controller in response to the vehicles' preemption requirements; and
a real-time status monitor verifying preemption of the at least one intersection controller.

18. A method of preempting an intersection, comprising:
estimating the location of at least one vehicle;
providing the estimated location to a fleet management system;
determining whether any of the vehicles require the preemption of an intersection;
forwarding the estimated location of vehicles requiring preemption to a traffic management system;
sending a preemption request to an intersection controller in satisfaction of the preemption requirements of at least one of the vehicles, the intersection controller receiving a preemption request and preempting one or more traffic lights at an intersection in response; and
verifying preemption of the traffic lights at the intersection.

19. The method of claim 18, further comprising resolving conflicts between the preemption requirements of multiple vehicles.

20. The method of claim 19, further comprising assigning priorities to vehicles and resolving conflicts between the preemption requirements of multiple vehicles by honoring the preemption requirements of the highest priority vehicle.

21. The method of claim 18, further comprising estimating vehicle location using information obtained using a GPS receiver.

22. The method of claim 21, further comprising estimating vehicle location using map matching.

* * * * *

UNITED STATES PATENT AND TRADEMARK OFFICE

CERTIFICATE OF CORRECTION

PATENT NO. : 7,098,806 B2
APPLICATION NO. : 10/965408
DATED : August 29, 2006
INVENTOR(S) : Bachelder It is certified that error appears in the above-identified patent and that said Letters Patent is hereby corrected as shown below:

On the Title Page

| | |
|---|---|
| (56) References Cited<br>U.S. Patent Documents<br>pg. 2, Column 1<br>6,909,380. . . | Delete “B1”,<br>Insert --B2-- |
| (56) References Cited<br>Other Documents<br>pg. 2, Column 2, 4th Ref. | Delete “Traffic Preemption System for Emergency and Transit”,<br>Insert --Traffic Signal Preemption for Emergency and Transit-- |
| (56) References Cited<br>Other Documents<br>pg. 2, Column 2, 15th Ref.<br>Veerender Kaul, . . . | After “Will it Threaten”,<br>Insert --the-- |
| (56) References Cited<br>Other Documents<br>pg. 2, Column 2, 23rd Ref.<br>Assessment of the Application of. . . | Delete “AutomaticVehicle”,<br>Insert --Automatic Vehicle-- |
| (56) References Cited<br>Other Documents<br>pg. 2, Column 2, 23rd Ref.<br>Assessment of the Application of. . . | Delete “JUl.”,<br>Insert --Jul.-- |
| (56) References Cited<br>Other Documents<br>pg. 2, Column 2, 24th Ref.<br>R.M. Griffin and D. Johnson, A Report. . . | Delete “[before]”,<br>Insert --'before'-- |
| (56) References Cited<br>Other Documents<br>pg. 2, Column 2, 27th Ref.<br>N. B. Hounsell, Active Bus. . . | Delete “Colloquiumm”,<br>Insert --Colloquium-- |

UNITED STATES PATENT AND TRADEMARK OFFICE

CERTIFICATE OF CORRECTION

PATENT NO. : 7,098,806 B2
APPLICATION NO. : 10/965408
DATED : August 29, 2006
INVENTOR(S) : Bachelder It is certified that error appears in the above-identified patent and that said Letters Patent is hereby corrected as shown below:

| | |
|---|---|
| (56) References Cited<br>Other Documents<br>pg. 2, Column 2, 29th Ref.<br>P.L. Belcher and I. Catling,<br>Autoguide-Electronic. . . | After "1989",<br>Insert --IEEE-- |
| (56) References Cited<br>Other Documents<br>pg. 3, Column 1, 7th Ref.<br>A. Ceder and A. Shmilovits, A<br>Traffic. . . | Delete "Highway System",<br>Insert --Highway Systems-- |
| (56) References Cited<br>Other Documents<br>pg. 3, Columm 2, 16th Ref.<br>R.L. Sabounghi, Intelligent Vehicle<br>Highway.. . | After "Highway System -",<br>Insert --The Universal Close-Range Road/<br>Vehicle Communication System Concept -- |

In the Specification

| | |
|---|---|
| Column 1, line 14 | Insert -- STATEMENT REGARDING<br><br>FEDERALLY SPONSORED RESEARCH OR<br><br>DEVELOPMENT<br><br>The invention described herein was made in the performance of work under a NASA contract, and is subject to the provisions of Public Law 96-517 (35 U.S.C. 202) in which the contractor has elected to retain title.-- |

In the Claims

| | |
|---|---|
| Column 11, line 56, Claim 12 | Delete "estimate",<br>Insert --estimated-- |

UNITED STATES PATENT AND TRADEMARK OFFICE

CERTIFICATE OF CORRECTION

PATENT NO. : 7,098,806 B2
APPLICATION NO. : 10/965408
DATED : August 29, 2006
INVENTOR(S) : Bachelder It is certified that error appears in the above-identified patent and that said Letters Patent is hereby corrected as shown below:

| | |
|---|---|
| Column 12, line 11, Claim 16 | Delete "on-odd",<br>Insert --add-on-- |

Signed and Sealed this

Twenty-ninth Day of May, 2007

JON W. DUDAS
*Director of the United States Patent and Trademark Office*